US009797231B2

(12) United States Patent
Welton et al.

(10) Patent No.: US 9,797,231 B2
(45) Date of Patent: Oct. 24, 2017

(54) METHODS OF COATING PROPPANT PARTICULATES FOR USE IN SUBTERRANEAN FORMATION OPERATIONS

(71) Applicant: Halliburton Energy Services, Inc., Houston, TX (US)

(72) Inventors: Thomas Donovan Welton, Houston, TX (US); Philip D. Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1113 days.

(21) Appl. No.: 13/870,535

(22) Filed: Apr. 25, 2013

(65) Prior Publication Data

US 2014/0318779 A1 Oct. 30, 2014

(51) Int. Cl.
*E21B 43/25* (2006.01)
*C09K 8/80* (2006.01)
*E21B 43/267* (2006.01)

(52) U.S. Cl.
CPC ..... *E21B 43/267* (2013.01)

(58) Field of Classification Search
CPC ..... E21B 43/267; E21B 43/26
See application file for complete search history.

(56) References Cited

U.S. PATENT DOCUMENTS 3,929,191 A * 12/1975 Graham ..... C09K 8/5086 166/276
3,998,271 A * 12/1976 Cooke, Jr. ..... C09K 8/62 166/280.1
4,336,842 A * 6/1982 Graham ..... C09K 8/56 166/276
4,518,039 A * 5/1985 Graham ..... C09K 8/805 166/276
4,585,064 A 4/1986 Graham et al.
4,597,991 A * 7/1986 Graham ..... C09K 8/805 427/214
4,694,905 A * 9/1987 Armbruster ..... B01J 2/006 166/280.2
4,717,594 A * 1/1988 Graham ..... C09K 8/805 427/214
4,732,920 A * 3/1988 Graham ..... C09K 8/56 523/139
4,888,240 A * 12/1989 Graham ..... C09K 8/56 166/276
5,420,174 A * 5/1995 Dewprashad ..... C09K 8/685 507/220
5,422,183 A * 6/1995 Sinclair ..... C09K 8/62 166/280.2
5,597,784 A * 1/1997 Sinclair ..... C09K 8/62 166/280.2
5,837,656 A * 11/1998 Sinclair ..... C09K 8/805 166/280.2
5,905,061 A 5/1999 Patel
5,977,031 A 11/1999 Patel
6,311,773 B1 11/2001 Todd et al.
6,582,819 B2 6/2003 McDaniel et al.
6,677,426 B2 1/2004 Noro et al.
6,828,279 B2 12/2004 Patel et al.
7,032,667 B2 * 4/2006 Nguyen ..... C09K 8/805 166/280.2
7,063,151 B2 6/2006 Nguyen et al.
7,153,575 B2 12/2006 Anderson et al.
7,216,711 B2 5/2007 Nguyen et al.
7,261,156 B2 8/2007 Nguyen et al.
7,264,051 B2 9/2007 Nguyen et al.
7,334,635 B2 * 2/2008 Nguyen ..... C09K 8/805 166/280.1
7,350,571 B2 4/2008 Nguyen et al.
7,407,010 B2 8/2008 Rickman et al.
7,490,667 B2 * 2/2009 Sinclair ..... C09K 8/805 166/278
7,534,745 B2 5/2009 Taylor et al.
7,645,723 B2 1/2010 Kirsner et al.
7,696,131 B2 4/2010 Oyler et al.
8,136,593 B2 * 3/2012 Weaver ..... C09K 8/68 166/280.1
8,227,026 B2 * 7/2012 McDaniel ..... C09K 8/805 427/212
8,240,383 B2 * 8/2012 Xu ..... C09K 8/805 166/278
9,045,678 B2 * 6/2015 Rediger ..... C09K 8/805
2003/0224165 A1 * 12/2003 Anderson ..... C09K 8/805 428/403
2004/0221992 A1 * 11/2004 Nguyen ..... C09K 8/62 166/295
2005/0051332 A1 * 3/2005 Nguyen ..... C09K 8/805 166/281

(Continued)

*Primary Examiner* — Angela M DiTrani
*Assistant Examiner* — Crystal J Miller
(74) *Attorney, Agent, or Firm* — McDermott Will & Emery LLP

(57) ABSTRACT

Methods including providing resin double-coated proppant comprising proppant coated with a first resin and thereafter coated with a second resin atop of the first resin; wherein the first resin is curable by a first curing agent and wherein the second resin is curable by a second curing agent that is different than the first curing agent; curing the second resin by exposing it to the second curing agent; introducing the resin double-coated proppant into at least a portion of a fracture within a subterranean formation; breaking the cured second resin to expose the first resin; introducing the first curing agent into the portion of the fracture where the resin double-coated proppant was placed; and curing the first resin by exposing it to the first curing agent to form a proppant pack.

4 Claims, No Drawings

(56) References Cited

U.S. PATENT DOCUMENTS

| | | | | |
|---|---|---|---|---|
| 2006/0157243 | A1* | 7/2006 | Nguyen | C09K 8/805 166/280.2 |
| 2007/0277978 | A1* | 12/2007 | Reddy | C09K 8/5086 166/276 |
| 2008/0011477 | A1* | 1/2008 | Rediger | C09K 8/64 166/280.2 |
| 2008/0078547 | A1* | 4/2008 | Sinclair | C09K 8/805 166/278 |
| 2008/0202750 | A1* | 8/2008 | Rediger | C09K 8/805 166/280.2 |
| 2009/0238988 | A1* | 9/2009 | McDaniel | C09K 8/805 427/487 |
| 2009/0298720 | A1* | 12/2009 | Nguyen | C09K 8/74 507/204 |
| 2010/0282462 | A1* | 11/2010 | Xu | C09K 8/805 166/271 |
| 2011/0030949 | A1* | 2/2011 | Weaver | C09K 8/68 166/276 |
| 2011/0278003 | A1* | 11/2011 | Rediger | C09K 8/805 166/280.1 |
| 2012/0227967 | A1* | 9/2012 | Shaikh | C09K 8/805 166/280.1 |
| 2015/0275072 | A1* | 10/2015 | Rediger | C09K 8/805 427/215 |

* cited by examiner

METHODS OF COATING PROPPANT PARTICULATES FOR USE IN SUBTERRANEAN FORMATION OPERATIONS

BACKGROUND

The present invention relates to methods of coating proppant particulates for use in subterranean formation operations.

Subterranean wells (e.g., hydrocarbon producing wells or water producing wells) are often stimulated by hydraulic fracturing treatments. In traditional hydraulic fracturing treatments, a fracturing fluid, which may also function simultaneously or subsequently as a carrier fluid, is pumped into a portion of a subterranean formation at a rate and pressure sufficient to break down the formation and create one or more fractures therein. Typically, particulate solids, such as graded sand, are suspended in a portion of the fracturing fluid and then deposited into the fractures. These particulate solids, known as "proppant particulates" or simply "proppant," serve to prevent the fractures from fully closing once the hydraulic pressure is removed. By keeping the fractures from fully closing, the proppant particulates aid in forming conductive paths through which fluids produced from the formation may flow.

The degree of success of a fracturing operation depends, at least in part, upon fracture porosity and conductivity once the fracturing operation is complete and production is begun. Traditional fracturing operations place a large volume of proppant particulates into a fracture to form a "proppant pack" in order to ensure that the fracture does not close completely upon removing the hydraulic pressure. The ability of proppant particulates to maintain a fracture open depends upon the ability of the proppant particulates to withstand fracture closure without crushing and, therefore, is typically proportional to the strength and volume of proppant particulates placed in the fracture. The porosity of a proppant pack within a fracture is created by the interconnected interstitial spaces between abutting proppant particulates through which produced fluids may flow. Thus, it is imperative that the proppant particulates remain in place within the fracture and that the interstitial spaces between them be open such that fluids may freely flow therethrough.

One problem that may be associated with the success of a proppant pack within a fracture is obstruction of the near-wellbore region of the fracture. Proppant particulates (and other formation solids such as formation fines) deep within the fracture may flow back during stimulation and/or production and cause buildup in the proppant pack in the near-wellbore region of the fracture. The result is reduced interstitial spaces in the near-wellbore region of the proppant pack, causing a plugging effect that may substantially reduce the conductivity potential of a fracture in a subterranean formation.

A way proposed to combat such problems involves placing a resin or other tackifying agent onto the proppant particulates in order to ensure that the proppant particulates (and formation fines) remain in place once they are placed within a fracture. As used herein, the term "tackifying" in all of its forms, refers to a substance that is generally sticky to the touch. However, traditional tacky proppant may tend to gather formation fines that can stick onto the proppant and prevent neighboring proppant particulates from properly adhering to one another in the proppant pack. Therefore, a method of coating proppant particulates that does not exhibit tackifying qualities until the proppant particulates are placed at a target interval may be of benefit to one of ordinary skill in the art.

SUMMARY OF THE INVENTION

The present invention relates to methods of coating proppant particulates for use in subterranean formation operations.

In some embodiments, the present invention provides a method comprising: providing resin double-coated proppant comprising proppant coated with a first resin and thereafter coated with a second resin atop of the first resin; wherein the first resin is curable by a first curing agent and wherein the second resin is curable by a second curing agent that is different than the first curing agent; curing the second resin by exposing it to the second curing agent; introducing the resin double-coated proppant into at least a portion of a fracture within a subterranean formation; breaking the cured second resin to expose the first resin; introducing the first curing agent into the portion of the fracture where the resin double-coated proppant was placed; and curing the first resin by exposing it to the first curing agent to form a proppant pack.

In other embodiments, the present invention provides a method comprising: providing resin double-coated proppant comprising proppant coated with a first resin and thereafter coated with a second resin atop of the first resin; wherein the first resin is curable by a first curing agent and wherein the second resin is curable by an ultraviolet light; curing the second resin by exposing it to ultraviolet light; introducing the resin double-coated proppant into at least a portion of a fracture within a subterranean formation; breaking the cured second resin to expose the first resin; introducing the first curing agent into the portion of the fracture where the resin double-coated proppant was placed; exposing the first resin to the first curing agent to form a proppant pack.

In still other embodiments, the present invention provides a method comprising: providing resin double-coated proppant comprising proppant coated with a first resin and thereafter coated with a second resin atop of the first resin; wherein the first resin is curable by a first curing agent and wherein the second resin is curable by a second curing agent that is different than the first curing agent, providing resin hardening double-coated proppant comprising proppant coated with the first curing agent and thereafter coated with a third resin atop the first curing agent; wherein the third resin is curable by a third curing agent that is different than the first curing agent, curing the second resin on the resin double-coated proppant by exposing it to the second curing agent; curing the third resin on the resin hardening double-coated proppant by exposing it to the third curing agent; placing the resin double-coated proppant and the resin hardening double-coated proppant into at least a portion of a fracture within a subterranean formation; breaking the cured second resin so as to expose the first resin; breaking the cured third resin so as to expose the first curing agent; contacting the first resin with the first curing agent; and curing the first resin so as to form a proppant pack.

The features and advantages of the present invention will be readily apparent to those skilled in the art upon a reading of the description of the preferred embodiments that follows.

DETAILED DESCRIPTION

The present invention relates to methods of coating proppant particulates for use in subterranean formation operations.

In some embodiments, the present invention provides a method of treating at least one fracture in a wellbore in a subterranean formation comprising providing proppant particulates that have been double-coated with resin. This "resin double-coated proppant" comprises proppant particulates coated with a first resin and thereafter coated with a second resin, wherein the first resin and the second resin are curable by two different curing agents, a first curing agent and a second curing agent, respectively. After placement of the two resins on the proppant, the second resin is cured by exposing it to the second curing agent so that a hardened shell is formed that encases the first resin coated onto the proppant. The first resin is inactive while encased within the hardened shell. The resin double-coated proppant particulates and the first curing agent are then introduced into the wellbore in the subterranean formation and placed within a portion of a fracture. The resin double-coated proppant particulates may be introduced sequentially, such that the resin double-coated proppant particulates are first placed within the fracture and thereafter the first curing agent is added, or may be placed simultaneously. If the resin double-coated proppant particulates and the first curing agent are placed simultaneously into the fracture, they may both be dispersed in the same treatment fluid for said placement. As the fracture pressure is released and the fracture is allowed to close on the resin double-coated proppant, the hardened shell of the cured second resin is broken, which exposes the first resin. In the event that the fracture closure pressure does not break the shell of the cured second resin (whether by design or not), the hardened shell may be broken by other means (e.g., by non-mechanical means such as chemical breakers). One of ordinary skill, with the benefit of this disclosure, will understand the means to break the hardened shell of any of the cured resins, in accordance with these methods, for a particular application. Once the shell of the cured second resin is broken, the first resin may then be cured by exposing it to the first curing agent so as to form a consolidated proppant pack.

In some embodiments, the resin double-coated proppant is introduced into the at least one fracture in the subterranean formation with resin hardening double-coated proppant. The "resin hardening double-coated proppant" is first coated with the first curing agent that is capable of curing the first resin that was coated onto the resin double-coated proppant particulates. Thereafter the resin hardening double-coated proppant is coated with a third resin, and the third resin is cured with a third curing agent to form a hardened shell. The resin double-coated proppant and the resin hardening double-coated proppant are introduced into the wellbore in the subterranean formation and placed within a portion of a fracture either sequentially or simultaneously. Next, the hardened shell of the second resin coated onto the resin double-coated proppant and the hardened shell of the third resin coated onto the resin hardening double-coated proppant are broken so as to expose the first resin and the first curing agent, respectively. The hardened shells may be broken, for example, by the pressure of fracture closure or by other means as described above. Finally the first resin and the first curing agent are contacted together so as to cure the first resin and form a consolidated proppant pack.

In some embodiments, the second resin, which is the outermost resin coated onto the resin double-coated proppant, and the third resin, which is the outermost resin coated onto the resin hardening double-coated proppant, is preferably cured by the curing agent such that it does not exhibit tackifying qualities. When cured, the first resin may either cure to a hardened, non-tacky state or may be cured so that the resin remains tacky within the fracture.

In those embodiments where resin hardening double-coated proppant are used, the third curing agent must differ from the first curing agent but may be identical to the second curing agent. Therefore, the second and third resin may also be identical, but need not be. In some embodiments, the second curing agent is preferably an ultraviolet light curing agent. Use of an ultraviolet light curing agent for the outer resin coating (e.g., the second resin and the third resin) allows ease of handling because the outer resins can easily be cured in batches on, for example, a conveyer belt with ultraviolet light exposure.

The first, second, and third resins, collectively referred to herein as "resins," of the present invention may be any resin capable of being coated directly onto proppant particulates or being coated onto another resin or curing agent, provided that the first and second resins are curable by different means. As used herein, the term "resin" refers to any of numerous physically similar polymerized synthetics or chemically modified natural resins including thermoplastic materials and thermosetting materials. Examples of resins that can be used in the resin component include, but are not limited to, bisphenol A diglycidyl ether resin; butoxymethyl butyl glycidyl ether resin; bisphenol A-epichlorohydrin resin; bisphenol F resin; polyepoxide resin; novolak resin; polyester resin; phenol-aldehyde resin; urea-aldehyde resin; furan resin; urethane resin; glycidyl ether resin; an epoxide resin; and any combination thereof. Examples of suitable urethane resins may comprise a polyisocyanate component and a polyhydroxy component. Examples of suitable resins, including urethane resins that may be suitable for use in the methods of the present invention, include those described in U.S. Pat. Nos. 6,582,819; 4,585,064; 6,677,426; and 7,153,575, the entire disclosures of which are herein incorporated by reference. Examples of suitable commercially available resins for use in the methods of the present invention include, but are not limited to, Expedite® Proppant Flowback Control and Sand Wedge® Conductivity Enhancement System, available from Halliburton Energy Services, Inc. in Houston, Tex.

Other resins suitable for use in the present invention are furan-based resins. Suitable furan-based resins include, but are not limited to, a furfuryl alcohol resin; a furfural resin; a combination of a furfuryl alcohol resin and an aldehyde; a combination of a furan resin and a phenolic resin; and any combination thereof. Of these, furfuryl alcohol resins may be preferred. A furan-based resin may be combined with a solvent to control viscosity if desired. In some embodiments, the furan-based resins suitable for use in the present invention may be capable of enduring temperatures well in excess of 350° F. without degrading. In some embodiments, the furan-based resins suitable for use in the present invention are capable of enduring temperatures up to about 700° F. without degrading.

Still other resins suitable for use in the methods of the present invention are phenolic-based resins. Suitable phenolic-based resins include, but are not limited to, a terpolymer of phenol; a phenolic resin; a phenolic formaldehyde resin; a combination of a phenolic resin and a furan resin; and any combination thereof. In some embodiments, a combination of phenolic and furan resins may be preferred.

Yet another resin material suitable for use in the methods of the present invention is a phenol/phenol formaldehyde/furfuryl alcohol resin comprising of about 5% to about 30% phenol, of about 40% to about 70% phenol formaldehyde, of about 10% to about 40% furfuryl alcohol, of about 0.1% to about 3% of a silane coupling agent, and of about 1% to about 15% of a surfactant.

Any curing agent capable of curing (e.g., hardening) the first, second, or third resins may be used in the methods of the present invention. Suitable curing agents include, but are not limited to, a cyclo-aliphatic amine (e.g., piperazine, derivatives of piperazine, and modified piperazines); an aromatic amine (e.g., methylene dianiline, derivatives of methylene dianiline and hydrogenated forms); a 4,4'-diaminodiphenyl sulfone; an aliphatic amine (e.g., ethylene diamine, diethylene triamine, triethylene tetraamine, and tetraethylene pentaamine); imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; an amine; a polyamine; an amide; a polyamide; 2-ethyl-4-methyl imidazole; ultraviolet light; and any combination thereof. When the first, second, or third resin is a furan based resin, suitable curing agents may include, but are not limited to, maleic acid; fumaric acid; sodium bisulfate; hydrochloric acid; hydrofluoric acid; acetic acid; formic acid; phosphoric acid; sulfonic acid; alkyl benzene sulfonic acid (e.g., toluene sulfonic acid and dodecyl benzene sulfonic acid ("DDBSA")); and any combination thereof.

The chosen curing agent often affects the range of temperatures over which the resin is able to cure. By way of example, and not of limitation, in subterranean formations having a temperature of about 60° F. to about 250° F., amines and cyclo-aliphatic amines such as piperidine, triethylamine, tris(dimethylaminomethyl) phenol, and (dimethylaminomethyl)phenol may be preferred. In subterranean formations having higher temperatures, 4,4'-diaminodiphenyl sulfone may be a suitable curing agent. Curing agents that comprise piperazine or a derivative of piperazine have been shown capable of curing resins from temperatures as low as about 50° F. to as high as about 350° F.

The curing agents of the present invention may optionally comprise a solvent, silane coupling agent, a surfactant, and/or a hydrolyzable ester. Such additions may minimize any potential of premature curing of the resins. It is within the ability of one skilled in the art, with the benefit of this disclosure, to determine if and how much solvent, silane coupling agent, surfactant, and/or hydrolyzable ester may be needed to achieve a viscosity suitable to the subterranean conditions. Factors that may affect whether to include any of these optional items may include, for example, geographic location of the well, the surrounding weather conditions, and the like.

Any solvent that is compatible with the curing agent and resin and achieves the desired viscosity effect may be suitable for use in the methods of the present invention. The solvent may be added to the curing agent to reduce its viscosity for ease of handling, mixing and transferring or to reduce the viscosity of the resin upon contact. Suitable solvents may include, but are not limited to, butyl lactate; dipropylene glycol methyl ether; dipropylene glycol dimethyl ether; dimethyl formamide; diethyleneglycol methyl ether; ethyleneglycol butyl ether; diethyleneglycol butyl ether; propylene carbonate; methanol; butyl alcohol; d' limonene; a fatty acid methyl ester; butylglycidyl ether; isopropanol; a glycol either solvent; diethylene glycol methyl ether; dipropylene glycol methyl ether; 2-butoxy ethanol; an ether of a C2 to C6 dihydric alkanol containing at least one C1 to C6 alkyl group; a mono ether of dihydric alkanol; a mono ether of methoxypropanol; a mono ether of butoxyethanol; a mono ether of hexoxyethanol; tetrahydrofurfuryl methacrylate; tetrahydrofurfuryl acrylate; an ester of oxalic acid; an ester of maleic acid; an ester of succinic acids; furfuryl acetate; any isomers thereof; and any combination thereof. Selection of an appropriate solvent is dependent on the curing agent and resin composition chosen and is within the ability of one skilled in the art, with the benefit of this disclosure.

As described above, use of a solvent in the curing agents is optional but may be desirable to reduce viscosity for ease of handling, mixing, and transferring. However, as previously stated, it may be desirable in some embodiments to not use such a solvent for environmental or safety reasons. It is within the ability of one skilled in the art, with the benefit of this disclosure, to determine if and how much solvent is needed to achieve a suitable viscosity. In some embodiments, the amount of the solvent used in the first, second, and/or curing agents of the present invention may be in the range of about 0.1% to about 30% by weight of the complete first, second, and/or third curing agent.

The optional silane coupling agent may be used, among other things, to act as a mediator to help bond the resin to the proppant particulates. Examples of suitable silane coupling agents include, but are not limited to, N-2-(aminoethyl)-3-aminopropyltrimethoxysilane; 3-glycidoxypropyltrimethoxysilane; and any combination thereof. The silane coupling agent may be included in the curing agent component (according to the chemistry of the particular group as determined by one skilled in the art with the benefit of this disclosure). In some embodiments of the present invention, the silane coupling agent used is included in the curing agents in the range of about 0.1% to about 3% by weight of the first, second, or third curing agent.

Any surfactant capable of facilitating the coating of the resin onto the proppant particulates may be used in the methods of the present invention. Such surfactants include, but are not limited to, an alkyl phosphonate surfactant (e.g., a C12-C22 alkyl phosphonate surfactant); an ethoxylated nonyl phenol phosphate ester; a cationic surfactant; a nonionic surfactant; and any combination thereof. Examples of such surfactant combinations are described in U.S. Pat. No. 6,311,773, the entire disclosure of which is incorporated herein by reference. The surfactant or surfactants may be included in the curing agent in an amount in the range of about 1% to about 10% by weight of the curing agent.

The hydrolyzable ester may function to, among other things, break gelled treatment fluid films on proppant particulates or on subterranean formation faces. While not required, examples of hydrolyzable esters that may be used in the first, second, or third curing agents include, but are not limited to, dimethylglutarate; dimethyladipate; dimethylsuccinate; dimethylthiolate; methyl salicylate; dimethyl salicylate; and any combination thereof. When used, a hydrolyzable ester is included in the curing agent of the present invention in an amount in the range of about 0.1% to about 3% by weight of the curing agent. In some embodiments, a hydrolyzable ester is included in the curing agent of the present invention in an amount in the range of about 1% to about 2.5% by weight of the curing agent.

The resin (e.g., first, second, or third resin) and curing agent (e.g., first, second, or third curing agent) may be present in any amount so long as the resin is capable of being coated onto the proppant particulates, another resin, and/or a curing agent and the curing agent is capable of curing the resin. Generally, it is not possible to add too much curing agent, but it may be possible to add too little curing agent, thereby causing the resin to insufficiently cure. In some embodiments, the resin and the curing agent, when the curing agent is a chemical, may be present in a ratio of about 1:1 by weight. In other embodiments, the resin and the curing agent, when the curing agent is a chemical, may be present in a ratio of about 2:1 by weight.

The proppant particulates for use in the methods of the present invention may comprise any material suitable for use in subterranean operations. Suitable materials for the proppant particulates include, but are not limited to, sand; bauxite; ceramic materials; glass materials; polymer materials; polytetrafluoroethylene materials; nut shell pieces; cured resinous particulates comprising nut shell pieces; seed shell pieces; cured resinous particulates comprising seed shell pieces; fruit pit pieces; cured resinous particulates comprising fruit pit pieces; wood; composite particulates; and any combination thereof. Suitable composite particulates may comprise a binder and a filler material wherein suitable filler materials include, but are not limited to, silica; alumina; fumed carbon; carbon black; graphite; mica; titanium dioxide; meta-silicate; calcium silicate; kaolin; talc; zirconia; boron; fly ash; hollow glass microspheres; solid glass; and any combination thereof.

The mean proppant particulate size generally may range from about 2 mesh to about 400 mesh on the U.S. Sieve Series; however, in certain circumstances, other mean proppant particulate sizes may be desired and will be entirely suitable for practice of the present invention. In particular embodiments, preferred mean particulates size distribution ranges are one or more of 6/12, 8/16, 12/20, 16/30, 20/40, 30/50, 40/60, 40/70, or 50/70 mesh. It should be understood that the term "proppant particulate," as used in this disclosure, includes all known shapes of materials, including substantially spherical materials; fibrous materials; polygonal materials (e.g., cubic materials); and any combination thereof. Moreover, fibrous materials, that may or may not be used to bear the pressure of a closed fracture, may be included in certain embodiments of the present invention. In certain embodiments, the particulates may be present in the first treatment fluids of the present invention in an amount in the range of from about 0.5 pounds per gallon ("ppg") to about 30 ppg by volume of the treatment fluid.

The resin double-coated proppant and/or the resin hardening double-coated proppant may be introduced into a wellbore in a subterranean formation to be placed in at least one fracture in any treatment fluid suitable for use in a subterranean formation operation, provided that the treatment fluid does not adversely affect the resin and/or curing agent coating on the proppant particulates. Suitable treatment fluids for use in conjunction with the present invention may include, but are not limited to, oil-based fluids; aqueous-based fluids; aqueous-miscible fluids; water-in-oil emulsions; oil-in-water emulsions; and any combination thereof. Suitable oil-based fluids may include, but are not limited to, alkanes; olefins; aromatic organic compounds; cyclic alkanes; paraffins; diesel fluids; mineral oils; desulfurized hydrogenated kerosenes; and any combination thereof. Suitable aqueous-based fluids may include, but are not limited to, fresh water; saltwater (e.g., water containing one or more salts dissolved therein); brine (e.g., saturated salt water); seawater; and any combination thereof. Suitable aqueous-miscible fluids may include, but are not limited to, alcohols (e.g., methanol, ethanol, n-propanol, isopropanol, n-butanol, sec-butanol, isobutanol, and t-butanol; glycerins); glycols (e.g., polyglycols, propylene glycol, and ethylene glycol); polyglycol amines; polyols; any derivative thereof; any in combination with salts (e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate); any in combination with an aqueous-based fluid; and any combination thereof. Suitable water-in-oil emulsions, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base fluid, where the amount may range from any lower limit to any upper limit and encompass any subset therebetween. Examples of suitable invert emulsions include those disclosed in U.S. Pat. Nos. 5,905,061; 5,977,031; 6,828,279; 7,534,745; 7,645,723; and 7,696,131, each of which are incorporated herein by reference in their entirety. It should be noted that for water-in-oil and oil-in-water emulsions, any mixture of the above may be used, including the water being and/or comprising an aqueous-miscible fluid.

The treatment fluids of the present invention may further comprise an additive suitable for a particular subterranean formation operation. One of ordinary skill in the art, with the benefit of this disclosure, will recognize whether an additive should be included in the treatment fluids of the present invention for a particular application. Suitable additives include, but are not limited to, a salt; a weighting agent; an inert solid; a fluid loss control agent; an emulsifier; a dispersion aid; a corrosion inhibitor; an emulsion thinner; an emulsion thickener; a viscosifying agent; a gelling agent; a particulate; a gravel particulate; a lost circulation material; a foaming agent; a gas; a pH control additive; a breaker; a biocide; a crosslinker; a stabilizer; a scale inhibitor; a friction reducer; a clay stabilizing agent; and any combination thereof.

Embodiments disclosed herein include:

A. A method comprising providing resin double-coated proppant comprising proppant coated with a first resin and thereafter coated with a second resin atop the first resin, wherein the first resin is curable by a first curing agent and the second resin is curable by a second curing agent that is different than the first curing agent. The second curing agent is cured by exposing it to the second curing agent so as to form the resin double-coated proppant, which is introduced into at least a portion of a fracture within a subterranean formation. The second cured resin is broken so as to expose the first resin. The first curing agent is introduced into the portion of the fracture where the resin double-coated proppant was placed so as to come into contact with the first resin and cure it into a proppant pack.

B. A method comprising providing resin double-coated proppant comprising proppant coated with a first resin and thereafter coated with a second resin atop the first resin, wherein the first resin is curable by a first curing agent and the second resin is curable by ultraviolet light. The second curing agent is cured by exposing it to ultraviolet light so as to form the resin double-coated proppant, which is introduced into at least a portion of a fracture within a subterranean formation. The second cured resin is broken so as to expose the first resin. The first curing agent is introduced into the portion of the fracture where the resin double-coated proppant was placed so as to come into contact with the first resin and cure it into a proppant pack.

C. A method comprising providing resin double-coated proppant comprising proppant coated with a first resin and thereafter coated with a second resin atop the first resin, wherein the first resin is curable by a first curing agent and wherein the second resin is curable by a second curing agent that is different than the first curing agent. Additionally, resin hardening double-coated proppant is provided comprising proppant coated with the first curing agent and thereafter coated with a third resin atop the first curing agent, wherein the third resin is curable by a third curing agent that is different than the first curing agent. The second and third resins are cured so as to encase the first resin and the first curing agent, respectively. The resin double-coated proppant and the resin hardening double-coated proppant are placed into at least a portion of a fracture within a subterranean formation. The second resin is broken so as to expose the first resin and the third resin is broken so as to expose the first curing agent, allowing the first resin and the first curing agent to come into contact and cause the curing of the first resin so as to form a proppant pack.

Each of embodiments A, B, and C may have one or more of the following additional elements in any combination:

Element 1: Wherein the step of introducing the resin double-coated proppant and the first curing agent occurs simultaneously.

Element 2: Wherein the step of introducing the resin double-coated proppant and the resin hardening double-coated proppant occurs simultaneously.

Element 3: Wherein the first curing agent, the second curing agent, or the third curing agent further comprises at least one selected from the group consisting of a solvent; a silane coupling agent; a surfactant; a hydrolyzable ester; and any combination thereof.

Element 4: Wherein the first curing agent, the second curing agent, or the third curing agent further comprises a solvent selected from the group consisting of butyl lactate; dipropylene glycol methyl ether; dipropylene glycol dimethyl ether; dimethyl formamide; diethyleneglycol methyl ether; ethyleneglycol butyl ether; diethyleneglycol butyl ether; propylene carbonate; methanol; butyl alcohol; d' limonene; a fatty acid methyl ester; butylglycidyl ether; isopropanol; a glycol either solvent; diethylene glycol methyl ether; dipropylene glycol methyl ether; 2-butoxy ethanol; an ether of a C2 to C6 dihydric alkanol containing at least one C1 to C6 alkyl group; a mono ether of dihydric alkanol; a mono ether of methoxypropanol; a mono ether of butoxyethanol; a mono ether of hexoxyethanol; tetrahydrofurfuryl methacrylate; tetrahydrofurfuryl acrylate; an ester of oxalic acid; an ester of maleic acid; an ester of succinic acids; furfuryl acetate; any isomers thereof; and any combination thereof.

Element 5: Wherein the first curing agent, the second curing agent, or the third curing agent further comprises a silane coupling agent selected from the group consisting of N-2-(aminoethyl)-3-aminopropyltrimethoxysilane; 3-glycidoxypropyltrimethoxysilane; and any combination thereof.

Element 6: Wherein the first curing agent, the second curing agent, or the third curing agent further comprises a surfactant selected from the group consisting of an alkyl phosphonate surfactant; an ethoxylated nonyl phenol phosphate ester; a cationic surfactant; a nonionic surfactant; and any combination thereof.

Element 7: Wherein the first curing agent, the second curing agent, or the third curing agent further comprises a hydrolyzable ester selected from the group consisting of dimethylglutarate; dimethyladipate; dimethylsuccinate; dimethylthiolate; methyl salicylate; dimethyl salicylate; and any combination thereof.

Element 8: Wherein the first resin, the second resin, or the third resin is selected from the group consisting of a bisphenol A diglycidyl ether resin; a butoxymethyl butyl glycidyl ether resin; a bisphenol A-epichlorohydrin resin; a bisphenol F resin; a polyepoxide resin; a novolak resin; a polyester resin; a phenol-aldehyde resin; a urea-aldehyde resin; a furan-based resin; a phenolic-based resin; a urethane resin; a glycidyl ether resin; an epoxide resin; a phenol/phenol formaldehyde/furfuryl alcohol resin; and any combination thereof.

Element 9: Wherein the first curing agent, the second curing agent, or the third curing agent is selected from the group consisting of a cyclo-aliphatic amine; an aromatic amine; a 4,4'-diaminodiphenyl sulfone; an aliphatic amine; an imidazole; a pyrazole; a pyrazine; a pyrimidine; a pyridazine; a 1H-indazole; a purine; a phthalazine; a naphthyridine; a quinoxaline; a quinazoline; a phenazine; an imidazolidine; a cinnoline; an imidazoline; a 1,3,5-triazine; a thiazole; a pteridine; an indazole; an amine; a polyamine; an amide; a polyamide; 2-ethyl-4-methyl imidazole; ultraviolet light; maleic acid; fumaric acid; sodium bisulfate; hydrochloric acid; hydrofluoric acid; acetic acid; formic acid; phosphoric acid; sulfonic acid; alkyl benzene sulfonic acid; and any combination thereof.

Element 10: Wherein the second curing agent and/or the third curing agent is ultraviolet light.

By way of non-limiting example, exemplary combinations applicable to A, B, C include: A with 1, 8, and 9; A with 6 and 10; B with 8 and 9; or C with 4, 5, and 10.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

providing resin double-coated proppant comprising proppant coated with a first resin and thereafter coated with a second resin atop of the first resin;

wherein the first resin is curable by a first curing agent and wherein the second resin is curable by an ultraviolet light;

first, curing the second resin by exposing it to ultraviolet light;

second, introducing the resin double-coated proppant into at least a portion of a fracture within a subterranean formation;

third, breaking the cured second resin to expose the first resin;

fourth, introducing the first curing agent into the portion of the fracture where the resin double-coated proppant was placed; and fifth, exposing the first resin to the first curing agent to form a proppant pack.

2. The method of claim 1, wherein the first resin and second resin are selected from the group consisting of a bisphenol A diglycidyl ether resin; a butoxymethyl butyl glycidyl ether resin; a bisphenol A-epichlorohydrin resin; a bisphenol F resin; a polyepoxide resin; a novolak resin; a polyester resin; a phenol-aldehyde resin; a urea-aldehyde resin; a furan-based resin; a phenolic-based resin; a urethane resin; a glycidyl ether resin; an epoxide resin; a phenol/phenol formaldehyde/furfuryl alcohol resin; and any combination thereof.

3. The method of claim 1, wherein the first curing agent is selected from the group consisting of a cyclo-aliphatic amine; an aromatic amine; a 4,4'-diaminodiphenyl sulfone; an aliphatic amine; an imidazole; a pyrazole; a pyrazine; a pyrimidine; a pyridazine; a 1H-indazole; a purine; a phthalazine; a naphthyridine; a quinoxaline; a quinazoline; a phenazine; an imidazolidine; a cinnoline; an imidazoline; a 1,3,5-triazine; a thiazole; a pteridine; an indazole; an amine; a polyamine; an amide; a polyamide; 2-ethyl-4-methyl imidazole; maleic acid; fumaric acid; sodium bisulfate; hydrochloric acid; hydrofluoric acid; acetic acid; formic acid; phosphoric acid; sulfonic acid; alkyl benzene sulfonic acid; and any combination thereof.

4. The method of claim 1, wherein the first curing agent is a chemical curing agent, and the ratio of the first resin to the first curing agent is about 1:1 by weight or about 2:1 by weight.

* * * * *